US009236170B2

(12) United States Patent
Fu et al.

(10) Patent No.: US 9,236,170 B2
(45) Date of Patent: Jan. 12, 2016

(54) ZNO MULTILAYER CHIP VARISTOR WITH BASE METAL INNER ELECTRODES AND PREPARATION METHOD THEREOF

(71) Applicant: Huazhong University of Science and Technology, Wuhan (CN)

(72) Inventors: Qiuyun Fu, Wuhan (CN); Dongxiang Zhou, Wuhan (CN); Yunxiang Hu, Wuhan (CN); Zhiping Zheng, Wuhan (CN); Wei Luo, Wuhan (CN); Tao Chen, Wuhan (CN)

(73) Assignee: HUAZHONG UNIVERSITY OF SCIENCE AND TECHNOLOGY, Wuhan (CN)

( * ) Notice: Subject to any disclaimer, the term of this patent is extended or adjusted under 35 U.S.C. 154(b) by 0 days.

(21) Appl. No.: 14/320,301

(22) Filed: Jun. 30, 2014

(65) Prior Publication Data

US 2015/0145638 A1 May 28, 2015

(30) Foreign Application Priority Data

Nov. 22, 2013 (CN) ..... 2013 1 0594610

(51) Int. Cl.

| | |
|---|---|
| ***H01C 7/10*** | (2006.01) |
| ***H01C 7/112*** | (2006.01) |
| ***H01C 7/18*** | (2006.01) |
| ***H01C 17/065*** | (2006.01) |

(52) U.S. Cl.

CPC ..... *H01C 7/1006* (2013.01); *H01C 7/112* (2013.01); *H01C 7/18* (2013.01); *H01C 17/06546* (2013.01); *Y10T 29/49082* (2015.01)

(58) Field of Classification Search

CPC ..... H01C 17/30; H01C 7/10; H01C 17/006; H01C 7/008

USPC ..... 338/20, 22 R; 29/610.1, 612

See application file for complete search history.

(56) References Cited

U.S. PATENT DOCUMENTS

| | | | | |
|---|---|---|---|---|
| 5,976,420 | A * | 11/1999 | Nakamura et al. | 252/516 |
| 5,994,995 | A * | 11/1999 | Ogasawara et al. | 338/21 |
| 6,232,867 | B1 * | 5/2001 | Yoshida et al. | 338/21 |
| 7,754,109 | B2 * | 7/2010 | Yoshida et al. | 252/519.51 |
| 8,471,673 | B2 * | 6/2013 | Tanaka et al. | 338/21 |
| 2008/0191834 | A1 * | 8/2008 | Lien et al. | 338/20 |

* cited by examiner

*Primary Examiner* — Kyung Lee

(74) *Attorney, Agent, or Firm* — Davis Wright Tremaine LLP

(57) ABSTRACT

Provided are a multilayer chip ZnO varistor with base metal inner electrodes and a preparation method thereof. The varistor is formed by ceramic sheets and inner electrodes which were alternately laminated. Wherein the main material of inner electrodes is the base metal nickel(Ni), both ends of the varistor are coated with silver electrodes. The present invention has the following beneficial effects: (1) the material formula of ZnO varistor is suitable for the preparation process of reduction and reoxidation; (2) the base metal Ni is used as inner electrodes which can sharply reduce the preparation cost of a multilayer chip ZnO varistor; (3) using a conventional solid-phase sintering method, it can complete the burning of silver and the oxidation of the ceramic simultaneously which is suitable for mass production; (4) the nonlinear coefficient of the ZnO multilayer chip varistor produced by the method of this invention can reach 30 or more, the varistor breakdown voltage is less than 20V and the size can be standard chip package size 0805,0603,0402 and 0201.

6 Claims, 1 Drawing Sheet

ZNO MULTILAYER CHIP VARISTOR WITH BASE METAL INNER ELECTRODES AND PREPARATION METHOD THEREOF

CROSS-REFERENCE TO RELATED APPLICATIONS

The present application is a U.S. non-provisional application which claims priority to Chinese Application No. 201210594610.4, filed on Nov. 22, 2013, which is herein incorporated by reference in its entirety.

FIELD OF THE INVENTION

The invention belongs to the technical field of electronic ceramic components. More specifically, the invention relates to a ZnO multilayer chip varistor with base metal inner electrodes and a preparation method thereof.

BACKGROUND OF THE INVENTION

A varistor is a passive electronic component which has the characteristic of nonlinearity with respect to I-V (current-voltage). Varistors are used mainly for overvoltage protection and voltage stabilization. ZnO quickly became the leading varistor material because of its excellent nonlinear characteristics, after being successfully developed in 1968 by Panasonic.

The chip varistor emerged in 1981 which first reported by Panasonic. This chip varistor used technology relating to laminated ceramic green sheets and platinum (Pt) inner electrodes; since that time, ZnO-based varistor featuring low-voltage multilayer chips have been successfully developed. TDK, Mitsubishi, EPCOS and some other companies have undertaken sustained research on the multilayer chip varistor. At the beginning of this century, the 0402-package multilayer varistor was developed in succession by companies including AVX, TDK, LITTELFUSE, AMOTECH, EPCOS and some others. Murata and Panasonic have developed the chip varistor with a smaller 0201-package geometry; the breakdown voltage of this chip varistor is as low as 2.5V, and it can meet the ESD protection requirements of semiconductor devices of different performances and structures. The chip varistor has been researched extensivelr in recent years, with remarkable results being achieved in the basic research on chip varistor materials, as well as its precision manufacturing processes.

Currently single layer varistors typically have a thickness of 1 mm or so, with the film thickness of each layer of ZnO multilayer chip varistor typically being as thin as several tens of micrometers,which allow the breakdown voltage to be reduced by reducing the amounts of grains in single film. National Taiwan University reported the multilayer chip varistor wherein each layer has only 1-2 grains and wherein the thickness is 8 μm after being sintered. Ceramic green sheets having such thickness can also increase the average grain size of ZnO by increasing the sintering temperature, lengthening the sintering time, adding sintering aids, and so on, in order to reduce the breakdown voltage. Currently, multilayer chip varistors mainly employ systems of ZnO materials, with precious metals, such as silver (Ag), palladium (Pd) etc., as inner electrodes, and using a preparation method invoving firing in air.

With the decrease of layer thickness and the increase numbering number of layers, the mass proportion of the materials comprising the inner electrode within low voltage multilayer chip varistor is growing. Because the sintering temperature of ZnO varistor materials is generally higher than 1000° C., the high melting point alloy Ag/Pd (with a molar ratio of 30:70) must by used as the inner electrode material; this alloy accounts for over 50% of the total varistor cost. Further, the sintering process involves a ZnO—$Bi_2O_3$ system, with $Bi_2O_3$ being highly volatile and prone to reacting with the Pd electrode material, thereby reducing device performance. Many researchers and manufacturers are studying the replacemeny of the Ag/Pd inner electrode with cheaper materials, such as silver (Au) and cooper(Cu), by reducing the sintering temperature of the ZnO chip varistor. In this century, major companies have been attempting to reduce varistor costs as a result of the high costs associated with multilayer chips varistor prepared by this method, in particular due to the sharp increase of Pd and some other noble metal electrodes. Lavrov demonstrated that Cu can be co-fired and can be compatible when used as an electrode with a ZnO varistor ceramic, but the preparation method is very complex (Lavrov et al., *Journal of the European Cermaic Society*, 24 :2591-5 (2004)); in 2011, Changzhou Star John Technology Co., Ltd. announced a patent about the preparation of ZnO varistors wherein the Ag/Pd electrode is replaced by an electrode of pure Ag, but the cost of Ag electrodes remains high. Methods of reduction and re-oxidation have been used to prepare a multilayer chip varistor using as system of $SrTiO_3$ materials, wherein the base metal is used as the inner electrodes, as in the patent JP2002222703A of TDK, patent JP2005085780A of Panasonic and the patent US20070273468. However, these and other methods suffer from the very low varistor nonlinear coefficient (below 10), which limits the field of potential varistor applications.

SUMMARY OF THE INVENTION

The object of the present invention is to prepare a multilayer low-voltage chip varistor with base metal inner electrodes, while meeting the requirements of high nonlinear coefficient and low breakdown voltage. The present invention uses the base metal material nickel (Ni) to replace Ag/Pd and additionally uses some other noble metal materials to prepare the inner electrode slurry. The oxidation of the base metal inner electrode is prevented by co-firing the green body of the multilayer chip varistor with base metal inner electrodes at high temperature in a protective atmosphere. The silver electrodes of both ends of the varistor should then be burned at a relative lower temperature in oxidizing atmosphere.

To achieve the above object, we have provided a method of preparing a ZnO multilayer chip varistor with base metal inner electrodes according to the present invention, comprising the steps of:

(1) adding the oxides of manganese (Mn) and cobalt (Co) into the mixture of zinc oxide (ZnO) and bismuth oxide ($Bi_2O_3$), adding deionized water thereto for ball-mill mixing, drying and sieving generated slurry thereby obtaining a powder with a molar fraction of ZnO is 93% to 98.7%, a molar fraction of $Bi_2O_3$ is 0.2% to 5%, and molar fractions of Mn oxide and the Co oxide of 0.01% to 5% each in the powder;

(2) mixing the dispersing agent, defoaming agent, solvent and binder with the powder, and then ball-milled to obtain a slurry;

(3) tape casting the slurry, thereby obtaining one or more green sheets, using nickel (Ni) as a main material for base metal inner electrodes, and laminating, pressing and cutting the green sheets into rectangular to obtain molded samples;

(4) sintering the molded samples at the temperature of 850-1150° C. in a protective atmosphere, thereby obtaining a ceramic chip varistor;

(5) coating both ends with silver electrode and performing heat treatment thereon in oxygen or air at temperature of 500° to 800° C., thereby burning Ag electrodes, and obtaining a ZnO multilayer chip varistors with base metal inner electrodes.

Preferably, an oxide of aluminum (Al) and/or an oxide of niobium (Nb) is/are added into the mixture of ZnO and $Bi_2O_3$, wherein the oxide aluminum (Al) and/or the oxide of niobium (Nb) is added in a total amount of no greater than 4 mol % of said mizxture of ZnO and $Bi_2O_3$.

Preferably, any one or more of an oxide of chromium (Cr), an oxide of antimony (Sb), an oxide of silicon (Si) and an oxide of vanadium (V) is/are added into said mixture of ZnO and $Bi_2O_3$, wherein the one or more of an oxide of chromium (Cr), oxide of antimony (Sb), oxide of silicon (Si), and oxide of vanadium (V) is added in a total amount of no greater than 8 mol % of said mixture of ZnO and $Bi_2O_3$.

The aim of adding the oxides of Al, or Nb, or Cr, or Sb, or Si, or V of any one or more is to improve the varistor nonlinear coefficient, thereby reducing the leakage current, enhancing the stability and improving the aging characteristics. Preferably, the duration of ball-mill mixing in said step (1) is 3 to 5 hours. Preferably, the oxidation process, i.e. the oxidation of the chip varistor, can be performed simultaneously with the burning of Ag electrodes.

As another aspect of the present invention, a ZnO multilayer chip varistor with base metal inner electrodes based on the above-mentioned method is also provided.

According to another aspect of the present invention, there is provided a ZnO multilayer chip varistor with base metal inner electrodes, wherein the varistor is generated by alternately laminating ceramic chips and inner electrodes, wherein said inner electrode has a base metal of nickel (Ni), and both ends of the varistor are coated with silver (Ag) electrode.

Overall, in comparing the existing technologies with the technical solution designed by present invention, as detailed in steps (1)-(5) above, the advantages of the present invention over the prior art comprise the following:

(1) the powder uses in the ZnO varistor formulation is suitable for the reduction and reoxidation preparation process;

(2) the present invention uses the base metal Ni as inner electrode, which can greatly reduce the production cost of multilayer chip varistors;

(3) the sintering of silver and the oxidation of the ceramic can be completed simultaneously via a conventional solid-phase sintering method, thereby rendering the process suitable for mass production;

(4) the nonlinear coefficient of ZnO multilayer chip varistors prepared by the method of this invention can reach 30 or more and the breakdown voltage is less than 20V.

BRIEF DESCRIPTION OF ACCOMPANYING DRAWINGS

DETAILED DESCRIPTION OF THE INVENTION

For clear understanding of the objectives, features and advantages of the invention, a detailed description of the invention will be given below in conjunction with accompanying drawings and specific embodiments. It should be noted that the embodiments are only meant to explain the invention, and not to limit the scope of the invention.

The main material of the varistor in the present invention is ZnO. In addition to ZnO, oxides of Bi, Mn and Co are required ingredients. An oxide of Al and/or an oxide of Nb may be added, or one or more of oxides of Cr, Sb, Si and V may be added.

After the aforementioned oxide are sufficiently mixed, the green sheets are prepared by tape casting, and the base metal inner electrode slurry is printed, the green body is formed by repeating laminating, printing, laminating, and finally being cut into rectangular after being isostatically pressed.

The aforementioned green body is sintered in protective atmosphere, wherein the sintering temperature is between 850° C. and 1150° C., the optimum sintering temperature is related to the ingredients and the proportions thereof. The ceramic body formation is incomplete if the temperature is too low, and electrical properties of the device deteriorate if the temperature is too high. Silver electrode are coated at both ends of the ceramic body and the laminated chip varistor is then prepared by performing heat treatment in oxygen or air at temperature of 500° C. to 800°C.

Figure 1:
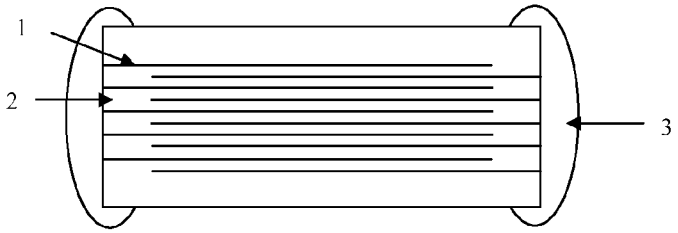
FIG. 1 is a schematic diagram of a ZnO multilayer chip varistor with base metal inner electrodes prepared by the present invention.

FIG. 1, depicts a ZnO multilayer chip varistor with base metal inner electrodes prepared by the present invention. The varistor is formed by ceramic layer (2) and inner electrode (1) which were overlapped alternately, wherein the material of inner electrode (1) is base metal with nickel (Ni) as a main material, and both ends of the varistor are coated with silver (Ag) electrode (3).

Figure 2:
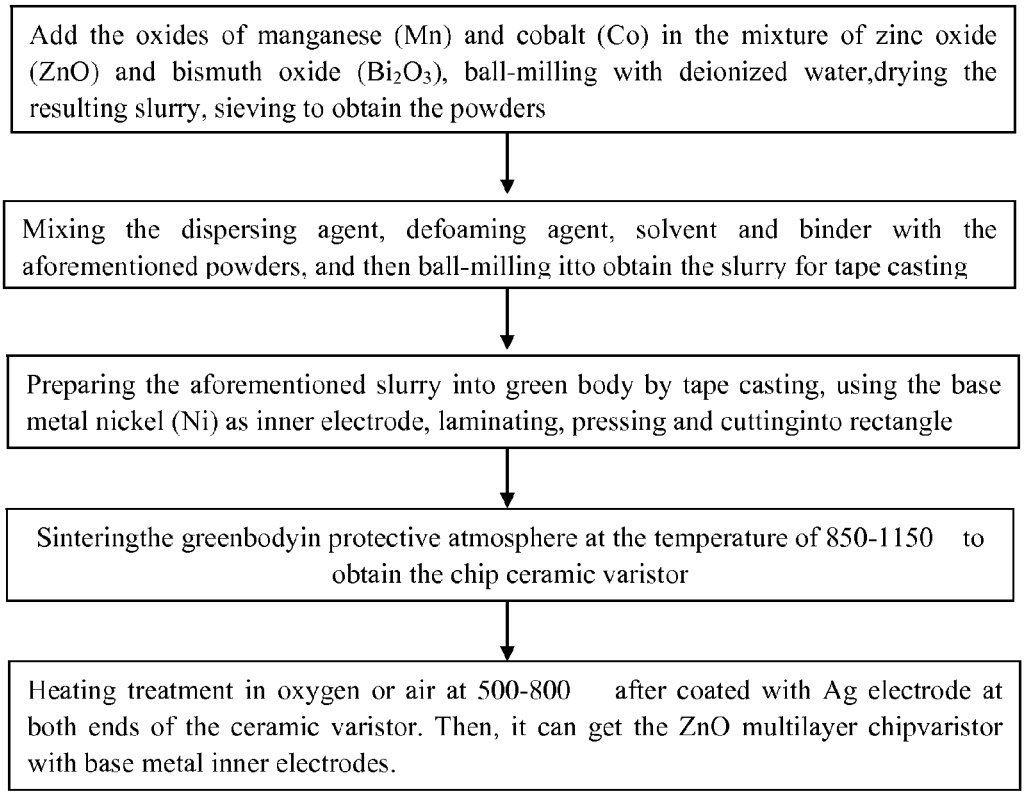
FIG. 2 is a flowchart of the varistor preparation process proposed by the present invention.

FIG. 2, depicts a method of preparing the ceramic material of a ZnO multilayer chip varistor with base metal inner electrodes to manufacture the ZnO varistor mentioned in the present invention, which via the following processes:

(1) adding the oxides of manganese (Mn) and cobalt (Co) in the mixture of zinc oxide (ZnO) and bismuth oxide ($Bi_2O_3$), adding deionized water thereto for ball-mill mixing, drying and sieving generated a slurry thereby obtaining a powder with a molar fraction of ZnO is 93% to 98.7%, a molar fraction of $Bi_2O_3$ of 0.2% to 5%, and molar fractions of the Mn oxide and the Co oxide of 0.01% to 5% each in the powder;

(2) mixing the dispersing agent, defoaming agent, solvent and binder with the powder, and then ball-milling to obtain a slurry;

(3) tape casting the slurry thereby obtaining a green sheet, using nickel (Ni) as the main material for base metal inner electrodes, and laminating, pressing and cutting the green sheets into rectangulars to obtain molded samples;

(4) sintering the molded samples at the temperature of 850-1150° C. in a protective atmosphere, thereby obtaining a ceramic chip varistor;

(5) coating both ends with silver electrode and performing heat treatment thereon in oxygen or air at temperature of 500° to 800°, thereon, and burning Ag electrodes, and obtaining a ZnO multilayer chip varistor with base metal inner electrodes.

Advantageously, an oxide of aluminum (Al) and/or an oxide of niobium (Nb) is/are added into the mixture of ZnO and $Bi_2O_3$, wherein the oxide of aluminum (Al) and/or the oxide of niobium (Nb) is added in a total amount no greater than 4 mol % of said mixture of ZnO and $Bi_2O_3$. Advantageously, any one or more of an oxide of chromium (Cr), an oxide of antimony (Sb), an oxide of silicon (Si) and an oxide of vanadium (V) is/are added into said mixture of ZnO and $Bi_2O_3$, wherein the one or more of an oxide of chromium (Cr), oxide of antimony (Sb), oxide of silicon (Si), and oxide of vanadium (V) is added in a the total amount of no greater than 8 mol % of said mixture of ZnO and $Bi_2O_3$ The aim of adding the oxides of Al, or Nb, or Cr, or Sb, or Si, or V of any one or more is to improve the varistor nonlinear coefficient, thereby reducing the leakage current, enhancing the stability and improving the aging characteristics. The proportion of the organic solvent and the powders in the present invention can be adjusted according to film quality.

Advantages of the invention over the prior art comprise:

(1) the material used in the ZnO varistor formulation is suitable for the reduction and reoxidation preparation process;

(2) the base metal Ni is used as the main material of inner electrodes in this invention which can sharply reduce the cost of preparing such multilayer chip ZnO varistor;

(3) the sintering of silver and the oxidation of the ceramic can be completed simultaneously via a conventional solid-phase sintering method, thereby rendering the process suitable for mass production;

(4) the nonlinear coefficient of ZnO multilayer chip varistor produced by the method of this invention can reach 30 or more, the breakdown voltage is less than 20V and the size can conform to resistance package size 0805, 0603,0402 and 0201.

While preferred embodiments of the invention have been described above, the invention is not limited to the disclosure in the embodiments and the accompanying drawings. Any changes or modifications without departing from the spirit of the invention fall within the scope of the invention.

What is claimed is:

1. A method for preparing a ZnO multilayer chip varistor with base metal inner electrodes, comprising the steps of:

(1) adding oxides of manganese (Mn) and cobalt (Co) into a mixture of zinc oxide (ZnO) and bismuth oxide ($Bi_2O_3$), adding deionized water thereto for ball-mill mixing, drying and sieving to generate a slurry, thereby obtaining a powder with a molar fraction of ZnO of 93% to 98.7%, a molar fraction of $Bi_2O_3$ of 0.2% to 5%, and molar fractions of Mn oxide and Co oxide of 0.01% to 5% each in the powder;

(2) mixing a dispersing agent, defoaming agent, solvent and binder with the powder, and then ball-milling to obtain a slurry;

(3) tape-casting the slurry and cutting it, thereby obtaining one or more green sheets, using nickel (Ni) as a main material for base metal inner electrodes, and laminating, pressing and cutting the one or more green sheets into rectangles to obtain molded samples;

(4) sintering the molded samples at a temperature of 850-1150 ° C. in a protective atmosphere, thereby obtaining a ceramic chip varistor;

(5) coating both ends with silver electrode and performing heat treatment thereon in oxygen or air at a temperature of 500-800 ° C., thereby burning the Ag electrodes, and obtaining a ZnO multilayer chip varistor with the base metal inner electrodes.

2. The method of claim 1, wherein an oxide of aluminum (Al) and/or an oxide of niobium (Nb) is/are added into said mixture of ZnO and $Bi_2O_3$, wherein the oxide of aluminum (Al) and/or the oxide of niobium (Nb) is added in a total amount of no greater than 4 mol % of said mixture of ZnO and $Bi_2O_3$.

3. The method of claim 1, wherein one or more of an oxide of chromium (Cr), an oxide of antimony (Sb), an oxide of silicon (Si) and an oxide of vanadium (V) is/are added into said mixture of ZnO and $Bi_2O_3$, wherein the one or more of an oxide of chromium (Cr), oxide of antimony (Sb), oxide of silicon (Si), and oxide of vanadium (V) is added in a total amount of no greater than 8 mol % of said mixture of ZnO and $Bi_7O_3$.

4. The method of claim 1, wherein the ball-mill mixing in said step (1) is conducted for at least 3 hours.

5. The method of claim 1, wherein oxidation of the chip varistor is performed simultaneously with the burning of Ag electrodes.

6. A ZnO multilayer chip varistor with base metal inner electrodes prepared according to the method of claim 1.

* * * * *